US005983816A

United States Patent [19]

Tomita

[11] Patent Number: 5,983,816

[45] Date of Patent: Nov. 16, 1999

[54] EMBROIDERY DATA PROCESSING DEVICE FOR SEWING MACHINE

[75] Inventor: Shintaro Tomita, Nagoya, Japan

[73] Assignee: Brother Kogyo Kabushiki Kaisha, Nagoya, Japan

[21] Appl. No.: 09/048,340

[22] Filed: Mar. 26, 1998

[30] Foreign Application Priority Data

Mar. 28, 1997 [JP] Japan ..... 9-077531

[51] Int. Cl.[6] ..... D05B 21/00; D05C 5/02

[52] U.S. Cl. ..... 112/102.5; 364/470.09

[58] Field of Search ..... 112/102.5, 470.06, 112/475.19, 470.04, 456, 458, 445; 364/470.09, 470.07

[56] References Cited

U.S. PATENT DOCUMENTS 4,660,488 4/1987 Hanyu et al. ..... 112/454
4,942,836 7/1990 Sano et al. ..... 112/445
5,156,107 10/1992 Kyuno et al. ..... 112/445
5,390,126 2/1995 Kongho et al. ..... 112/456 X
5,692,448 12/1997 Shigeta ..... 112/475.19 X

*Primary Examiner*—Peter Nerbun
*Attorney, Agent, or Firm*—Oliff & Berridge, PLC

[57] ABSTRACT

In an embroidery data processing device, when a user selects one of embroidery patterns displayed on a pattern selecting screen of an LCD, a control device reads embroidery data of the selected embroidery pattern from a ROM or external ROM card. The control device compares size data in the embroidery data with size data of a sewing area. When the size data in the embroidery data is larger than the size data of the sewing area, a predetermined computing or operation is executed to convert the sewing data. As a result, the embroidery pattern formed on a workpiece cloth on the basis of the converted sewing data falls within the sewing area.

19 Claims, 13 Drawing Sheets

| |
|---|
| X DIRECTION SIZE |
| Y DIRECTION SIZE |
| FIRST STITCH X DATA |
| FIRST STITCH Y DATA |
| SECOND STITCH X DATA |
| SECOND STITCH Y DATA |
| ⋮ |
| N-TH STITCH X DATA |
| N-TH STITCH Y DATA |
| ⋮ |
| THREAD CUTTING DATA |
| THREAD CHANGE DATA |

FIG. 10B

EMBROIDERY DATA PROCESSING DEVICE FOR SEWING MACHINE

BACKGROUND OF THE INVENTION

1. Field of the Invention

This invention relates to an embroidery data processing device provided, for example, in a sewing machine, for processing embroidery data used when an operation pertaining an embroidery pattern is executed by the sewing machine in relation to a predetermined working area.

2. Description of the Related Art

There has recently been provided a household embroidery machine storing data of a number of embroidery patterns such as pictures and letters. A desired one or more of the embroidery patterns are selected by a user so that the selected embroidery patterns are formed on a workpiece cloth. The embroidery machine is previously set with a maximum range according to which an embroidery pattern can be formed on the workpiece cloth. This maximum range will hereinafter be referred to as "sewing area." The embroidery machine forms an embroidery pattern on the workpiece cloth on the basis of embroidery data corresponding to each of the embroidery patterns. The embroidery data is stored in an internal memory such as ROM provided in the machine or an external memory medium such as an external memory card (hereinafter, "embroidery card") detachably attached to the sewing machine body.

The embroidery patterns include those of letters, for example, numerals, alphabet, Japanese kana-characters and Chinese characters, and those of frames used for hemming emblems or Wappen and for other purposes. The letter patterns can be enlarged and reduced freely to be formed on the workpiece cloth. On the other hand, picture patterns such as those of flowers, elephants and vehicles cannot be changed in their sizes. Accordingly, embroidery data of the picture patterns are defined so that embroidery patterns formed on the workpiece cloth on the basis of the embroidery data fall within the above-mentioned sewing area.

The sewing area of the embroidery machine has recently been rendered larger and larger. With this, embroidery data of larger picture patterns corresponding to the larger sewing area have commercially been supplied. Since the larger picture patterns cannot fall within the small sewing area of the conventional embroidery machine, a user thereof cannot use the embroidery data (embroidery card) of larger picture patterns.

On the other hand, the larger sewing area increases a manufacturing cost of the embroidery machine. Furthermore, some of the users do not necessitate such a large sewing area as those commercially available. Accordingly, provision of embroidery machines having smaller sewing areas than conventional machines has been proposed for the purposes of reducing the manufacturing cost thereof and meeting a variety of necessity of the users. In the case of the embroidery machine having a smaller sewing area, however, only the currently available embroidery data of small embroidery patterns falling within the small sewing area thereof can be used. This results in a problem that the embroidery data used by the users of the embroidery machines having small sewing areas is reduced.

In order that the embroidery data may be used in the embroidery machines irrespective of the sizes of the sewing areas, originating the embroidery data according to the size of the sewing area has been proposed. However, the origination of the embroidery data according to the size of the sewing area is troublesome and increases the manufacturing cost of the embroidery machine.

SUMMARY OF THE INVENTION

Therefore, an object of the present invention is to provide an embroidery data processing device in which the embroidery data can be used irrespective of a working area in relation to which an operation pertaining an embroidery pattern is executed by the sewing machine.

The present invention provides an embroidery data processing device comprising storage means for storing embroidery data used when an operation pertaining an embroidery pattern is executed by sewing means in relation to a predetermined working area, readout means for reading the embroidery data from the storage means, and conversion means for converting the embroidery data read by the readout means so that the embroidery data corresponds to another working area differing from the predetermined working area.

According to the above-described device, all the embroidery data stored in the storage means can be used irrespective of the working area of the sewing means. Consequently, since the embroidery data need not be originated according to the types of the working areas, the manufacturing cost of the device can be reduced.

The device preferably further comprises a device body, and the storage means preferably comprises external storage means connected to the device body.

When the picture patterns such as flowers, animals or vehicles are deformed, the shapes of these picture patterns are sometimes collapsed such a degree that they cannot be recognized. On the other hand, even when the frame patterns used for hemming the emblems or Wappen are deformed, the identity of the patterns can be maintained. Accordingly, the conversion means preferably converts the embroidery data so that the embroidery data corresponds in size to said another working area or so that the embroidery data corresponds in configuration to said another working area.

The embroidery data preferably includes sewing data used when the embroidery pattern is sewn. In this case, details of the patterns are sometimes collapsed depending upon the types of the patterns when the patterns are reduced to a large extent. Furthermore, the embroidery patterns are desired to be formed on a peripheral edge of the working area when the embroidery patterns are frame patterns. In view of the foregoing, the conversion means preferably converts the sewing data so that the embroidery pattern has a maximum size in which the embroidery pattern falls within said another working area.

When the device is provided with display means for displaying the working area, the conversion means preferably converts the embroidery data to image data used when the embroidery pattern is displayed in the working area on the display means. The image data preferably has a maximum size in which the embroidery pattern falls within the working area displayed on the display means.

Furthermore, the embroidery data preferably includes display data used when a display mode of the embroidery pattern is displayed on a display area of another display means provided in the sewing means. In this case, the conversion means preferably converts the display data so that the display data corresponds to a display area of the second display means differing from the predetermined display area.

BRIEF DESCRIPTION OF THE DRAWINGS

Other objects, features and advantages of the present invention will become clear upon reviewing the following description of preferred embodiments thereof, made with reference to the accompanying drawings, in which:

FIGS. 10A and 10B show data structure in the RAM and data structure of the sewing data respectively;

DETAILED DESCRIPTION OF THE PREFERRED EMBODIMENTS

Figure 1:
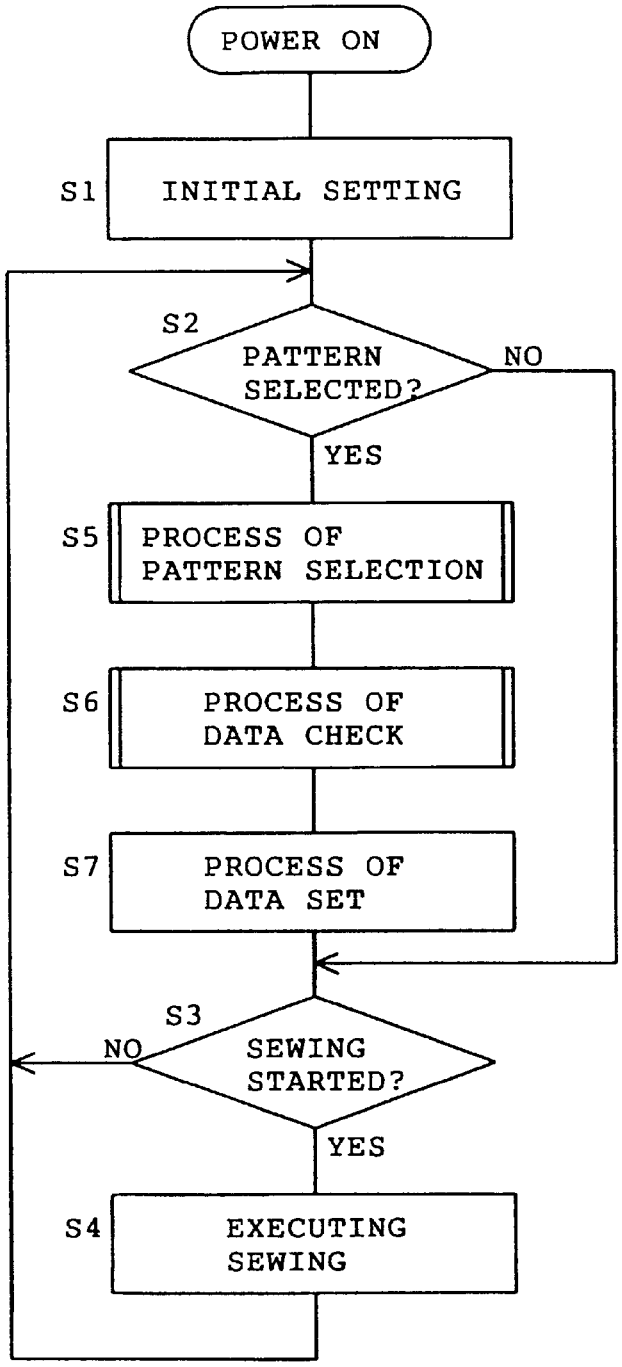
FIG. 1 is a flowchart showing the main routine of the operation of the embroidery data processing device of a first embodiment in accordance with the present invention, the operation covering from selection of an embroidery pattern to execution of the sewing.

A first embodiment will be described with reference to FIGS. 1 to 11. The present invention is applied to a household embroidery machine in the first embodiment. The embroidery machine has a function as an embroidery data processing device. Referring first to FIG. 4, an overall embroidery machine is schematically shown. The embroidery machine comprises a main body 1 including a bed 2 and an arm 3 formed integrally with and extending over the bed 2. A sewing head 5 is provided at a distal end of the arm 3. A needle bar 7 having a sewing needle 7*a* is mounted on the head 5. The head 5 is also provided with a ring-shaped presser foot 6 through which the sewing needle 7*a* passes. The presser foot 6 applies a suitable force to a workpiece cloth (not shown) to bias a part of the workpiece cloth through which the needle 4 passes. A throat plate 4 is mounted on an upper surface of the bed 2 so as to correspond to the needle bar 7. A shuttle mechanism (not shown) is provided in the bed 2 so as to be located under the throat plate 4. A sewing machine motor 8 (shown only in FIG. 3) is provided in the machine body 1 for synchronously driving the needle bar 7, the shuttle mechanism, etc. so that a sewing operation is executed.

An embroidering unit 11 is detachably attached to a left-hand end of the bed 2. The embroidering unit 11 comprises an embroidery frame 15 for holding the workpiece cloth and an embroidery frame moving mechanism 12 for moving the embroidery frame 15 horizontally, that is, in an X-axis direction and a Y-axis direction. The embroidery frame 15 includes an outer frame and an inner frame between which the workpiece cloth is sandwiched, so that the workpiece cloth can be held tightly stretched inside the embroidery frame 15 between the frame and the throat plate 4.

The embroidery frame moving mechanism 12 comprises a movable member 13 moved by an X-axis drive motor 16*a* (shown only in FIG. 3) freely in the X-axis direction, that is, leftward and rightward as viewed in FIG. 4. The moving mechanism 12 further comprises a moving arm 14 (not shown) provided in the movable member 13 to be moved by a Y-axis drive motor 16*b* (shown only in FIG. 3) freely in the Y-axis direction, that is, frontward and rearward, as shown in FIG. 4. The embroidery frame 15 is detachably attached to the moving arm 14. Consequently, the workpiece cloth held by the embroidery frame 15 can be moved by the embroidery frame moving mechanism 12 to an optional position based on an intrinsic X-Y coordinate system. An embroidering operation is performed when the needle bar 5, shuttle mechanism, presser foot, etc. are driven by the respective drive mechanisms while the workpiece cloth is moved freely relative to the needle bar 5 by the embroidery frame moving mechanism 12.

The embroidery machine of the embodiment is capable of performing a variety of ordinary sewing modes such as straight stitching, zigzag stitching and overcast stitching as well as embroidering. In case that the embroidering is not carried out, the embroidering unit 11 is removed from the bed 2 to be replaced by a flat table (not shown) for the ordinary sewing modes. A feed dog (not shown) is provided below the throat plate 4 to feed the workpiece cloth forward and backward while the sewing needle 7*a* assumes an upward position. A feed dog drive motor 9 (shown only in FIG. 3) is provided in the machine body 1 for driving the feed dog. A needle bar rocking motor 10 (shown only in FIG. 3) is also provided in the machine body 1 for displacing the needle bar 7 leftward and rightward. Consequently, a zig zag sewing and other ordinary sewing modes can be executed by the embroidery machine.

A start/stop key 21 is provided on a front surface of the head 5 as shown in FIG. 4. A power switch 28 is provided on the lower right-hand side surface of the machine main body 1. A card insertion slot 29 is provided in the right-hand side wall of the main body 1. An external ROM card 19 is inserted into the card insertion slot 29. The external ROM card 19 serves as external storage means as will be described later.

A monochrome liquid crystal display (LCD) 17 is provided on the front surface of the arm 3. The LCD 17 serves as display means for displaying a variety of patterns and messages. A touch panel 17 (shown only in FIG. 3) is provided on the surface of the LCD 17. The touch panel 18 includes various operation keys as well known in the art. The touch panel 17 comprises a number of transparent electrodes arranged vertically and horizontally and detects where the user touches it, as well known in the art.

Figure 3:
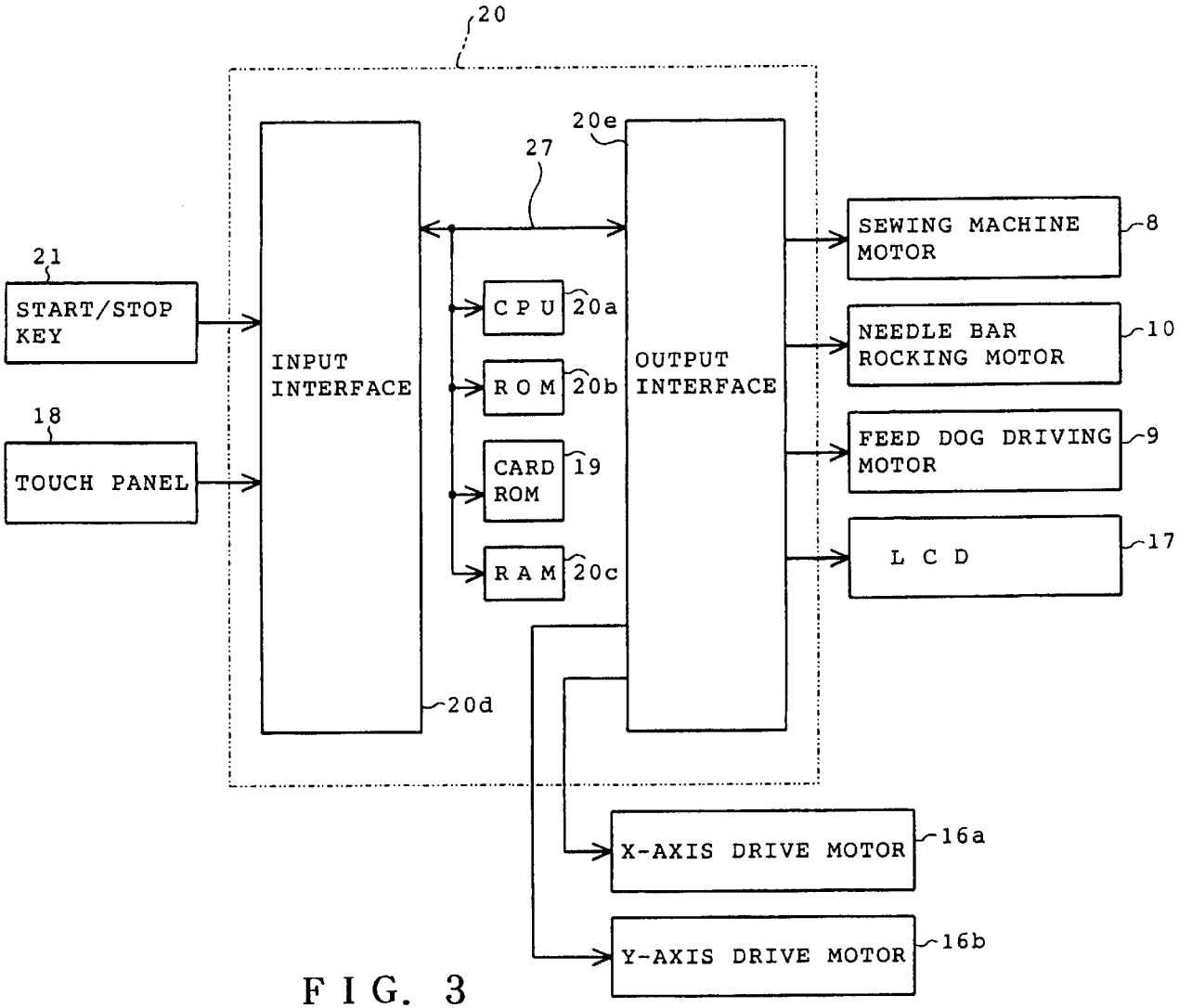
FIG. 3 is a schematic block diagram showing the electrical arrangement of the embroidery machine.
Figure 4:
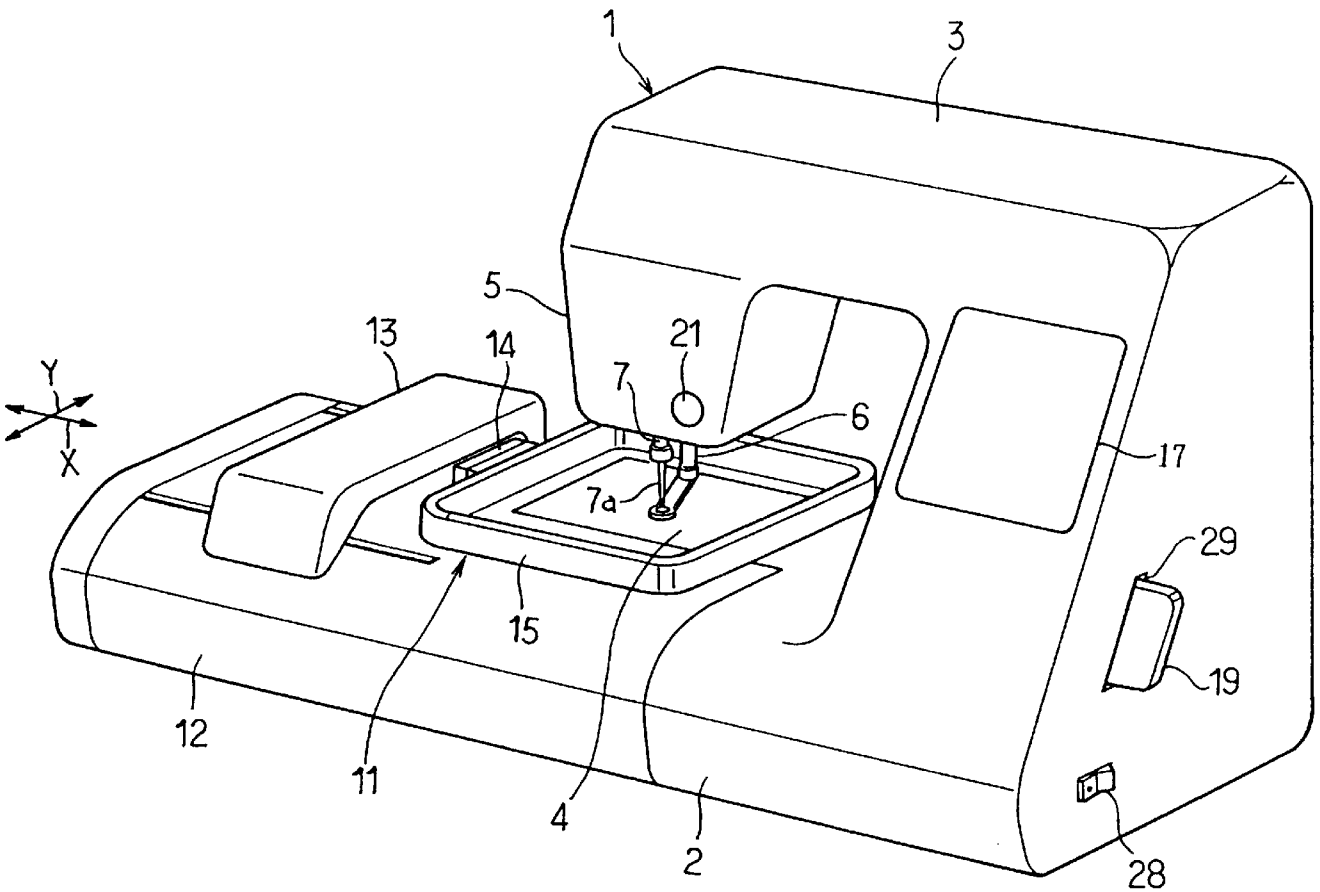
FIG. 4 is a perspective view of the embroidery machine.

Referring to FIG. 3, a microcomputer-based control device 20 is provided in the machine main body 1 for controlling the various mechanisms described above. The control device 20 includes an input interface 20*d*, output interface 20*e*, CPU 20*a*, ROM 20*b*, RAM 20*c* all connected by a bus 27. The sewing machine motor 8, the needle bar rocking motor 10, the feed dog drive motor 9, the LCD 17 are connected to the output interface 20*e*. Furthermore, the X direction drive motor 16*a* and the Y direction drive motor 16*b* are connected to the output interface 20*e* when the embroidering unit 11 is attached to the bed 2. On the other hand, the touch panel 18, the start/stop key 21, etc. are connected to the input interface 20*d*. The external ROM card 19 is also connected to the input interface 20*d* when inserted into the insertion slot 29.

The ROM 20*b* stores control programs for controlling the embroidering operation and other ordinary sewing operations of the machine main body 1, and a control program for controlling display of the LCD 17, a data processing program for performing various data processes such as readout and edit of embroidery data. The ROM 20*b* also stores size data indicative of the size (X direction length Y direction length) of a sewing area serving as a working area of the embroidery machine. The ROM 20*b* further stores embroidery data of a number of embroidery patterns including picture patterns and ornamental patterns formed by relatively simple shapes and for symbols and letters such as English alphabet, numerals and Japanese "kana." The ROM 20*b* thus serves as storage means in the invention.

In the embodiment, the embroidery data stored in the ROM 20*b* includes sewing data required for the embroidering, and display data formed from bit map data required for display of each pattern on the LCD 16. The sewing data includes size data indicative of a square occupied region encircling each embroidery pattern, needle movement data including an amount of X direction movement (X data) and an amount of Y direction movement (Y data) of the sewing needle 15 every one stitch, thread cut data, and thread change data, as shown in FIG. 10B. The above-mentioned occupied region will hereinafter be represented as "X direction length Y direction length." The display data is used when the embroidery patterns are displayed on a pattern selecting screen (FIG. 7) and an edit screen (FIG. 8) each serving as a display area and displayed by the LCD 17 as will be described later.

In the embodiment, the external ROM card 19 stores data of a large sized embroidery pattern a having an occupied region of "10×10," a middle sized embroidery pattern b having an occupied region of "7×8," and a small sized embroidery pattern c having an occupied region of "5×5." The ROM 20*b* stores data of embroidery patterns having the respective sizes falling within the sewing area though the sizes of occupied regions are eliminated.

Based on the programs stored in the ROM 20*b* and selecting operations performed on the touch panel 18 by the user, the control device 20 controls the various mechanisms of the embroidery machine so that the embroidering and other ordinary sewing operations are executed. As will be apparent from the following description, the control device 18 controls the LCD 17 to display thereon a menu selecting screen (see FIG. 5) and a pattern selecting screen. The user can select a desired embroidery pattern by touching the touch panel 18.

Additionally, the control device 20 reads, by means of software, the embroidery data of the selected embroidery pattern stored in the ROM 20*a* or the external ROM card 19. When the read embroidery data has a size larger than the sewing area of the embroidery machine, the control device 20 further converts the read embroidery data so that the size of the sewing data of the embroidery data corresponds to the sewing area of the sewing machine. Thus, the control device 20 serves as readout means and conversion means in the invention. In the conversion of the sewing data, the sewing data is processed with predetermined operation expressions. For this purpose, the ROM 20*b* stores data of a plurality of operation expressions.

Figure 5:
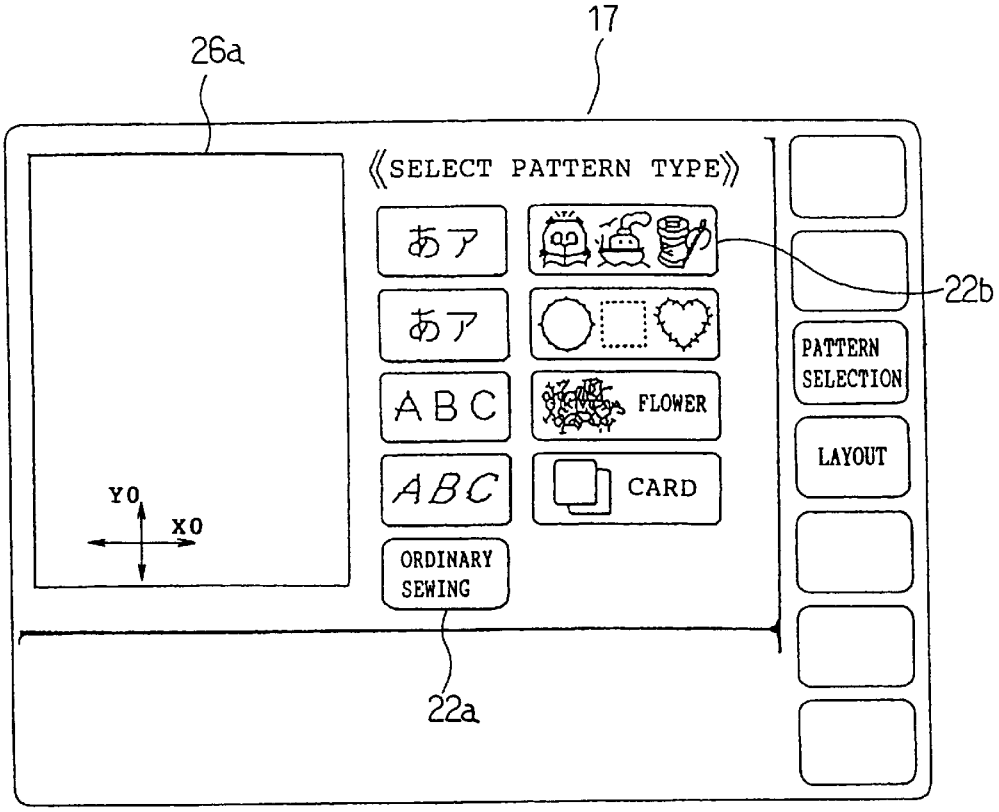
FIG. 5 shows a menu selecting screen (initial screen) displayed on the liquid crystal display (LCD)
Figure 6:
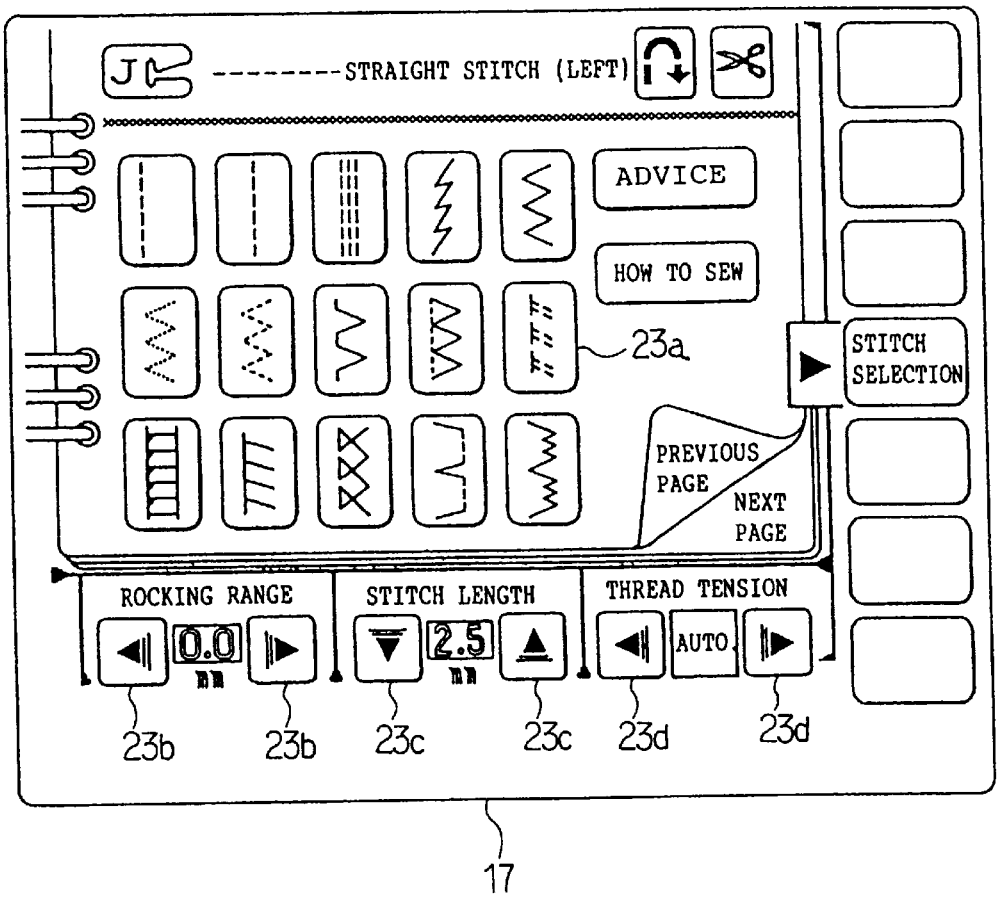
FIG. 6 shows an example of selection screen concerning the ordinary sewing modes displayed on the LCD.

The operation of the embroidery data processing device will now be described with reference to FIGS. 1 and 2. First, an initial screen is displayed by the LCD 17 when the power switch 28 is turned on (step S1). When the embroidering unit 11 is attached to the bed 2, the menu selecting screen as shown in FIG. 5 is displayed on the initial screen, whereas the selecting screen for the ordinary sewing as shown in FIG. 6 is displayed on the initial screen when the embroidering unit 11 is not attached to the bed 2.

Figure 7:
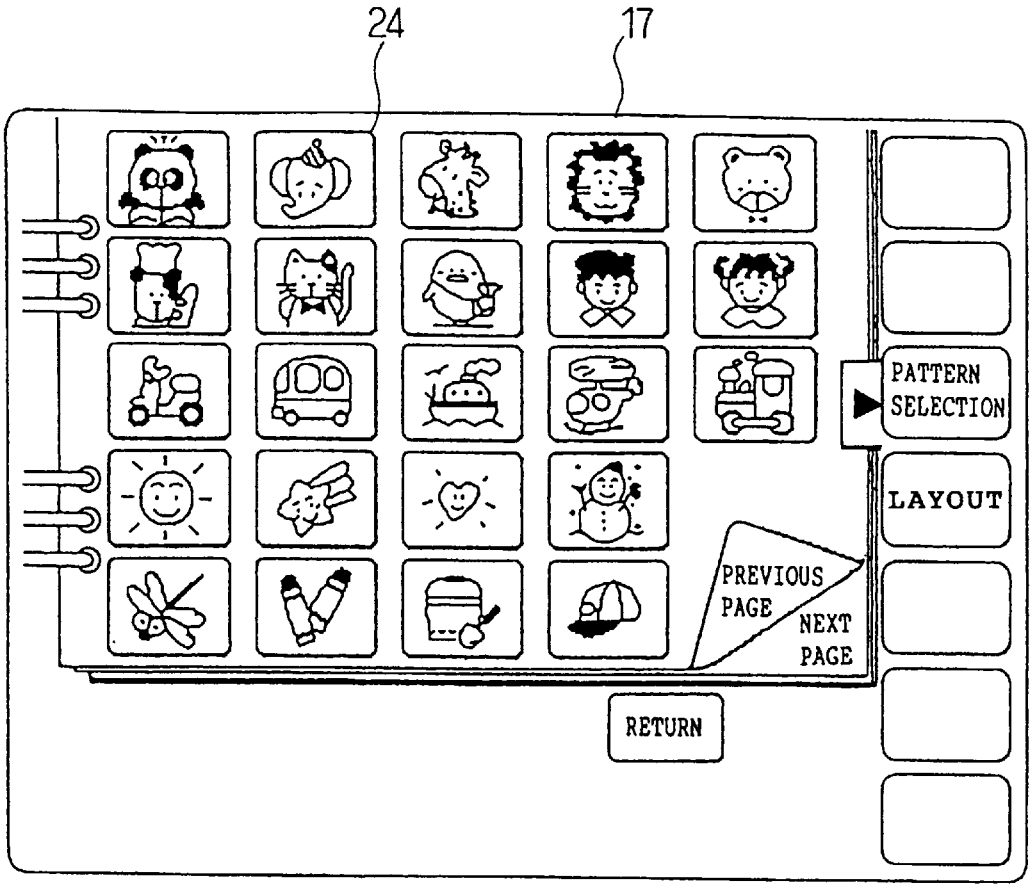
FIG. 7 shows an example of selection screen concerning the embroidery patterns displayed on the LCD.

Execution of the embroidering operation will first be described. The menu selecting screen displays nine selected items, that is, eight items 22*b* obtained by classifying a number of embroidery patterns and one item 22*a* of ordinary sewing. An item of CARD represents an embroidery pattern whose data is stored in the external ROM card 19. The other items on the screen represent the embroidery patterns stored in the ROM 20*b* respectively. The user operates the touch panel 18 to select an item corresponding to a desired embroidery pattern. The LCD 17 is then switched to a pattern selecting screen concerning the selected item (step S2). For example, a pattern selecting screen as shown in FIG. 7 is displayed when a right-hand uppermost item 22*b* of a picture pattern in FIG. 5 has been selected.

Figure 2A:
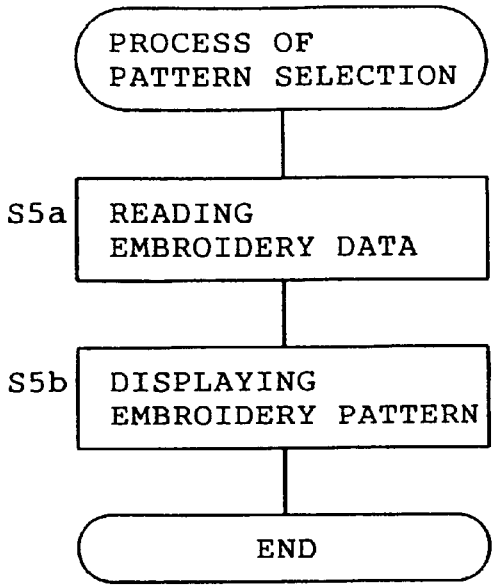
FIGS. 2A and 2B are flowcharts showing the subroutine of the pattern selecting process and the subroutine of the process for checking the data of the size of the selected embroidery pattern respectively.

When the user operates the touch panel 18 on the above-described pattern selecting screen to select a desired embroidery pattern (YES at step S2), the control advances to step S5 to execute the subroutine for the process of pattern selection. In this subroutine, the embroidery data of the selected embroidery pattern is read from the ROM 20*b* or the external ROM card 19 (step S5*a*), as shown in FIG. 2A. The LCD 17 is switched to a pattern confirmation screen (FIG. 8) at step S5*b*. The embroidery pattern is displayed on the pattern confirmation screen on the basis of the display data. On the pattern confirmation screen, the selected embroidery pattern and divided portions obtained by dividing the embroidery pattern by the number of thread colors are displayed together with the names of thread colors.

Figure 2B:
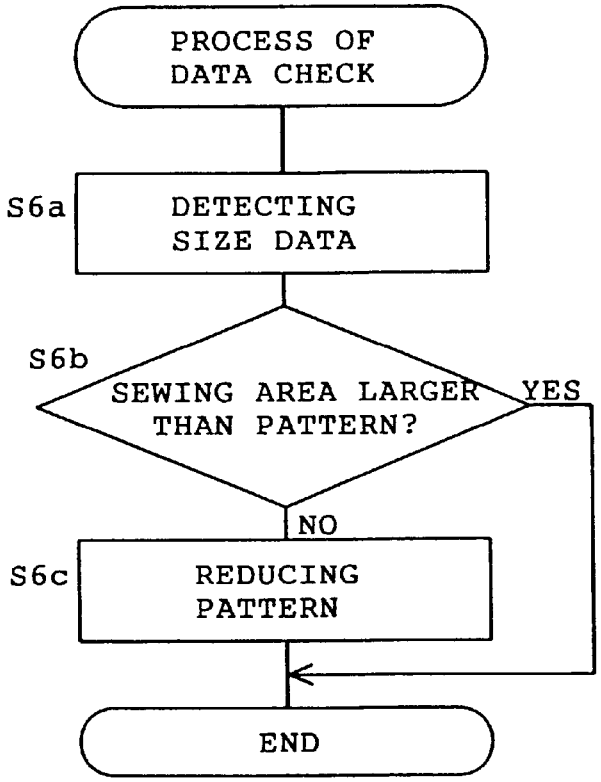
Figure 9:
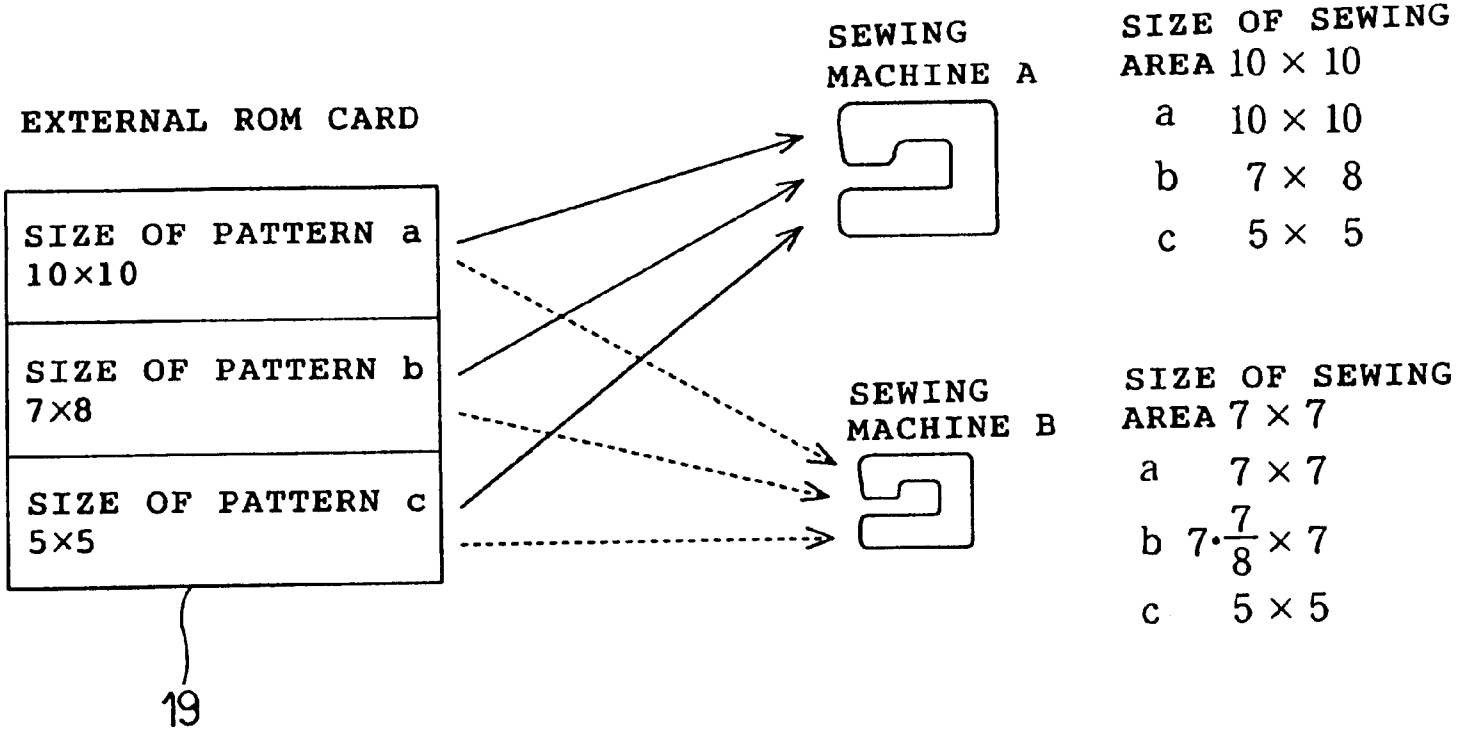
FIG. 9 is a view for explaining the manners of converting the sewing data.

Upon completion of the pattern selection process, the control returns to the main routine of FIG. 1, executing the subroutine for the process of data check at step S6. In the data check subroutine, the size data of the embroidery data is compared with the size data of the sewing area stored in the ROM 20*b* (steps S6*a* and S6*b*), as shown in FIG. 2B. Since each of the embroidery patterns whose data is stored in the ROM 20*b* has a size falling within the sewing area, the case where the pattern whose data is stored in the external ROM card 19 is selected will be described. For example, as shown in FIG. 9, the embroidery patterns a, b and c whose data is stored in the external ROM card 19 each fall within the sewing area when a large-sized sewing machine having the sewing area of "10×10" is used. Accordingly, the affirmative judgment is made at step S6*b* when any one of the embroidery patterns a, b and c is selected. The data check process is thus completed and the control returns to step S7 of FIG. 1.

On the other hand, when a smaller sewing machine having the sewing area of "7×7" is used, the large sized embroidery pattern a ("10×10") and the middle-sized embroidery pattern b ("7×8") do not fall within the sewing area though the small-sized embroidery pattern c ("5×5") falls within the sewing area, as shown in FIG. 9. Accordingly, the affirmative judgment is made at step S6*b* when the small-sized embroidery pattern c has been selected. The data check process is then completed and the control advances to step S7 of FIG. 1. On the other hand, when the embroidery pattern a or b is selected, the control device 20 judges in the affirmative at step S6*b* and then executes a process for reducing the embroidery pattern at step S6*c*. Thereafter, the control device 20 returns to step S7.

In the above-mentioned reducing process, the sewing data is converted so that the size of the embroidery pattern to be formed on the basis of the sewing data is reduced as compared with that of the original embroidery pattern. Furthermore, the sewing data is converted so that the embroidery pattern to be formed on the basis of the converted sewing data has a maximum size in which the embroidery pattern falls within the sewing area and is similar to the original embroidery pattern. In the conversion of the sewing data, one of a number of operation expressions whose data is stored in the ROM 20*b* is selected according to a reduction ratio. The sewing data is processed on the basis of the selected operation expression. More specifically, in the case of the large-sized pattern a having the size of "10×10," the sewing data is processed so that the original embroidery pattern is reduced to 7/10. In the case of the size of "7×8," the sewing data is processed so that the original embroidery pattern is reduced to 7/8.

Figure 10A:
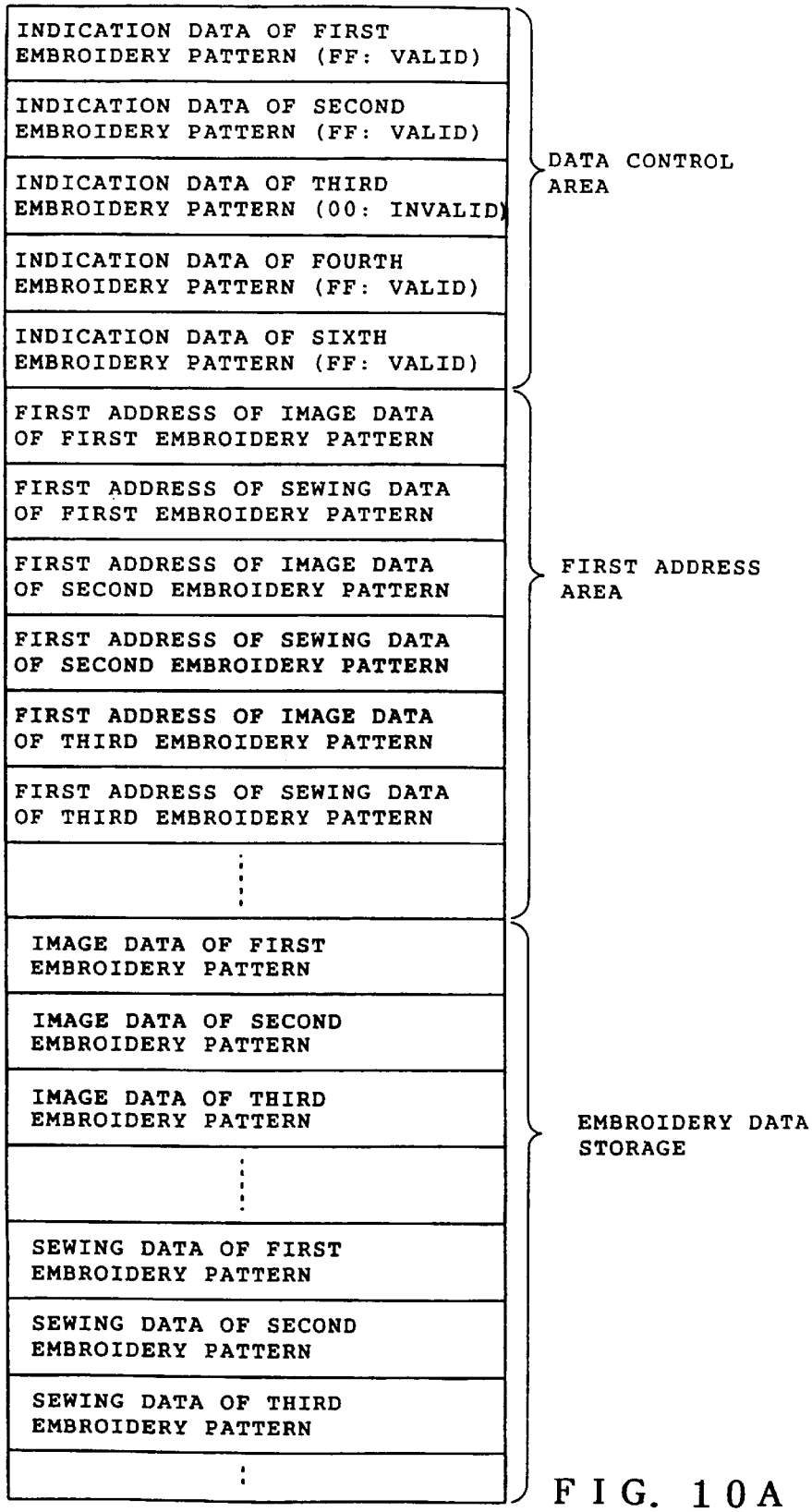

In the process of setting the data at step S7, indication data is written into a data control area of the RAM 20*c* as shown in FIG. 10A. The indication data is indicative of whether the sewing data of the selected embroidery pattern is valid or invalid. The indication data is set on the basis of the comparison between the accumulated number of times of selection of each embroidery pattern and a reference value previously set for each embroidery pattern. When the accumulated number of times of selection is above the reference value, an indication of invalidity, "00," is written into the data control area and the sewing operation on the basis of the sewing data is prohibited. An indication of validity, "FF," is written into the data control area when the accumulated number of times of selection is at or below the reference value and the sewing operation on the basis of the sewing data is allowed.

In the data setting process, furthermore, the sewing data of the selected embroidery pattern and the image data originated from the sewing data are written into an embroidery data storage area of the RAM 20*c*. In this case, the processed sewing data is written when the above-described reducing process has been executed. FIG. 10B shows the structure of the sewing data. Furthermore, a first address of the sewing data of each embroidery pattern and a first address of the image data are written into a first address area.

When the start/stop key 21 is turned on after the data setting process as described above (YES at step S3), the X direction drive motor 16*a,* the Y direction drive motor 16*b* and the sewing machine motor 8 are driven on the basis of the sewing data written into the RAM 20*c*. Consequently, the embroidery frame 15 is moved a predetermined amount for every stitch so that the embroidery pattern is formed on the workpiece cloth (step S4).

Figure 8:
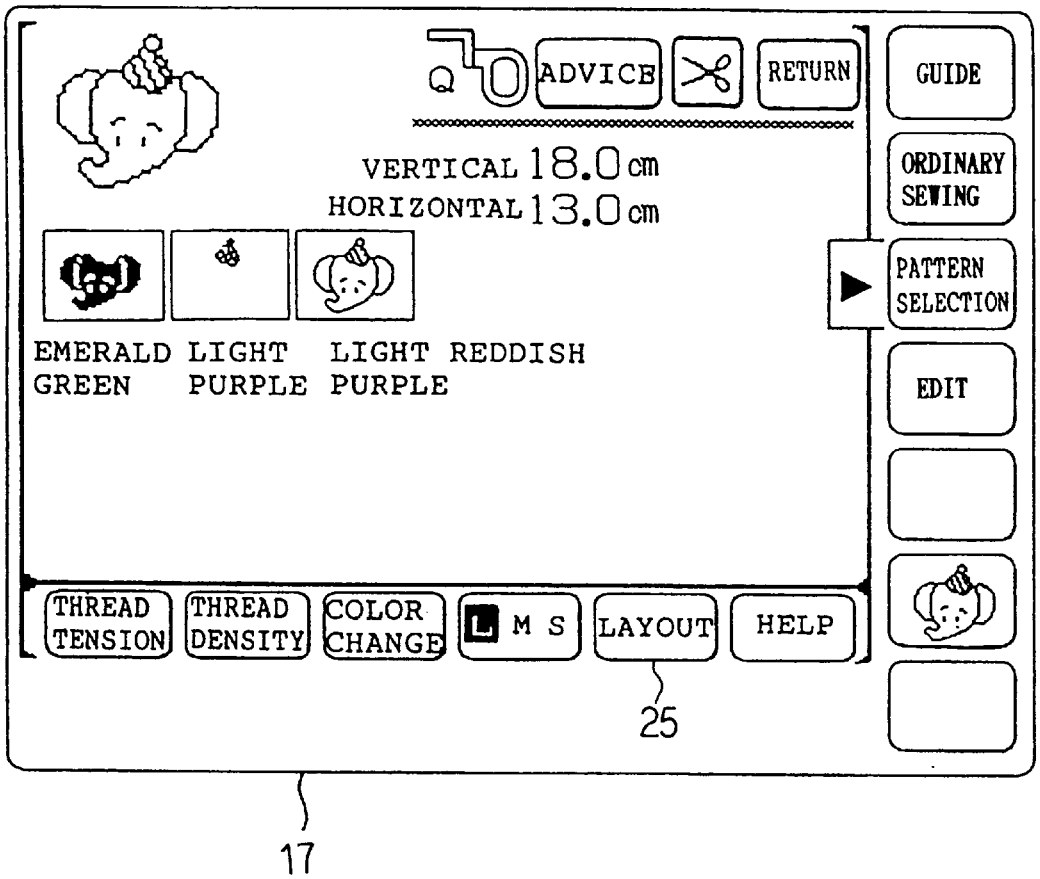
FIG. 8 shows an example of confirmation screen displayed on the LCD.
Figure 11:
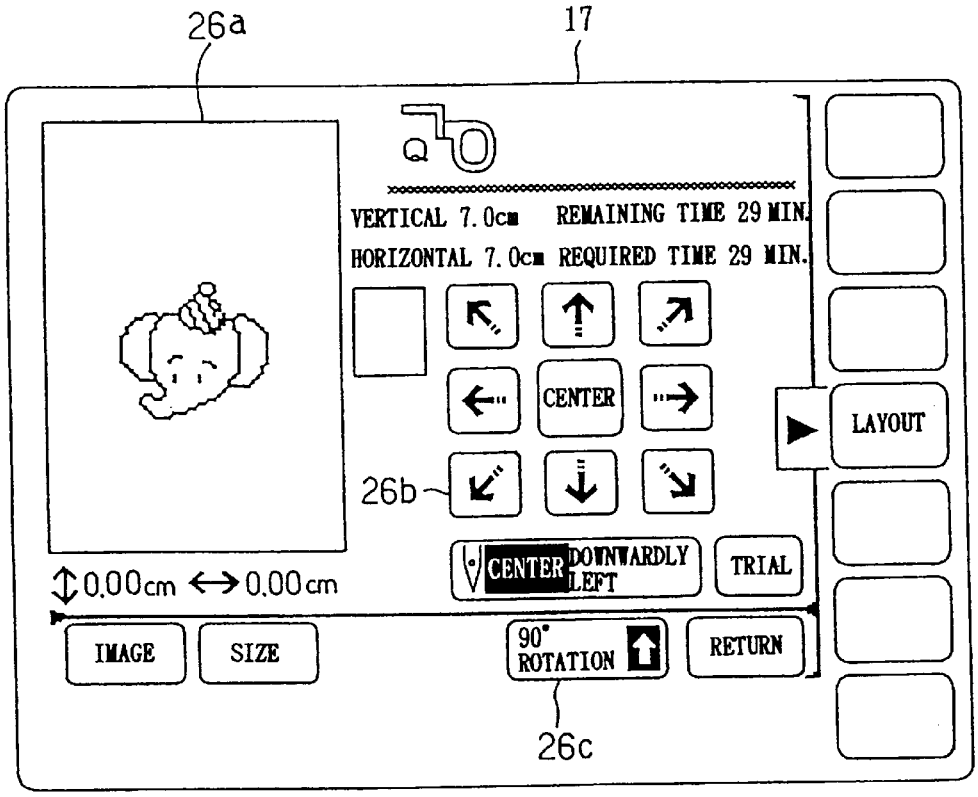
FIG. 11 shows an example of layout screen displayed on the LCD.

The LCD 17 is switched to a layout screen as shown in FIG. 11 when a LAYOUT key 25 is touched on the confirmation screen as shown in FIG. 8. A layout area 26*a* representative of the sewing area is displayed on the layout screen. The embroidery pattern is displayed within the layout area 26*a* on the basis of the image data written into the embroidery data storing area of the RAM 20*c*. The embroidery pattern displayed in the layout area 26*a* approximated to that actually formed on the workpiece cloth is displayed. A ratio of the size of the displayed embroidery pattern to the size of the layout area 26*a* is equalized to the ratio of the embroidery pattern to the size of the sewing area. Accordingly, the user can confirm the size of the embroidery pattern to be formed on the workpiece cloth during the sewing.

When the user selectively operates one of a plurality of arrow keys 26*b* or a rotation key 26*c* on the layout screen, the sewing data and the image data stored in the RAM 20*c* are re-written and the embroidery pattern displayed in the layout area 26*a* is moved or rotated. More specifically, when one of the arrow keys 26*b* is operated, the embroidery data is straightforwardly moved in the direction indicated by the operated arrow key 26*b*. The embroidery pattern is rotated 90 degrees every time the rotation key 26*c* is operated. Thereafter, when the start/stop key 21 is operated to start the sewing operation, an embroidery pattern having the same form (position and direction) as that displayed in the layout area 26*c* is formed within the sewing area.

The embroidering unit 11 is detached from the bed 2 and a sewing table is attached thereto when an ordinary sewing is to be executed. A desired stitch is selected on the ordinary sewing selecting screen as shown in FIG. 6 (step S1, NO at step S2). A number of stitch selecting keys 23*a* are displayed on the ordinary sewing selecting screen. A straight stitch (left) is set in the initial state. Accordingly, a selecting operation is executed only when one of the stitches except for the straight stitch is selected. The ordinary sewing selecting screen further displays a rocking range key 23*b* for setting a rocking range of the needle bar 7, a stitch key 23*c* for setting the length of stitch, and a thread tension key 23*d* for setting the thread tension.

When the above-mentioned keys 23*a* to 23*d* are operated and the start/stop key 21 is thereafter turned on (YES at step S3), the sewing machine motor 8 and other motors are driven so that the ordinary sewing is executed (step S4). The needle bar rocking motor 10 and the feed dog drive motor 9 are driven according to the operation of the rocking range key 23*b* and the stitch key 23*c*.

According to the above-described embodiment, the sewing data is converted so that the embroidery pattern falls within the sewing area when the embroidery pattern is larger in the size than the sewing area of the sewing machine, namely, even when the data of the embroidery pattern corresponds to a sewing area differing from that of the sewing machine under use. Consequently, even when the user possesses the sewing machine B (FIG. 9) having a small sewing area, he or she can use the data of all the embroidery patterns without limitation in the sizes of the embroidery patterns.

Furthermore, since the data of all the embroidery patterns is used irrespective of the size of the sewing area, the embroidery data need not be originated for every size of the sewing area, whereupon the manufacturing cost can be reduced. Additionally, already supplied embroidery data can be used even if embroidery machines having different sizes of sewing areas are produced to be sold.

The details of the embroidery pattern are sometimes collapsed when the embroidery pattern to be formed on the converted sewing data is provided by reducing the original embroidery pattern to a large degree. In the embodiment, however, the sewing data is converted so that the embroidery pattern has a maximum size in which the embroidery pattern falls within the sewing area. Consequently, the details of the embroidery pattern can be prevented from being collapsed. Furthermore, since the embroidery pattern to be formed on the basis of the converted sewing data is similar to the original embroidery pattern, the identity of the embroidery pattern can be maintained without deformation of the profile of the original pattern.

The image data is originated from the converted sewing data, and the embroidery pattern is displayed in the layout area of the LCD 17 on the basis of the originated image data. Consequently, the image of the embroidery pattern to be formed on the workpiece cloth can be confirmed on the screen of the LCD 17 before the embroidery pattern is actually formed.

In the foregoing embodiment, the invention is applied to the embroidery machine in which the workpiece cloth is moved relative to the sewing needle 7*a* for the execution of the embroidery forming operation. However, the invention may be applied to sewing machines in which the sewing needle is moved relative to the fixed workpiece cloth.

Figure 12:
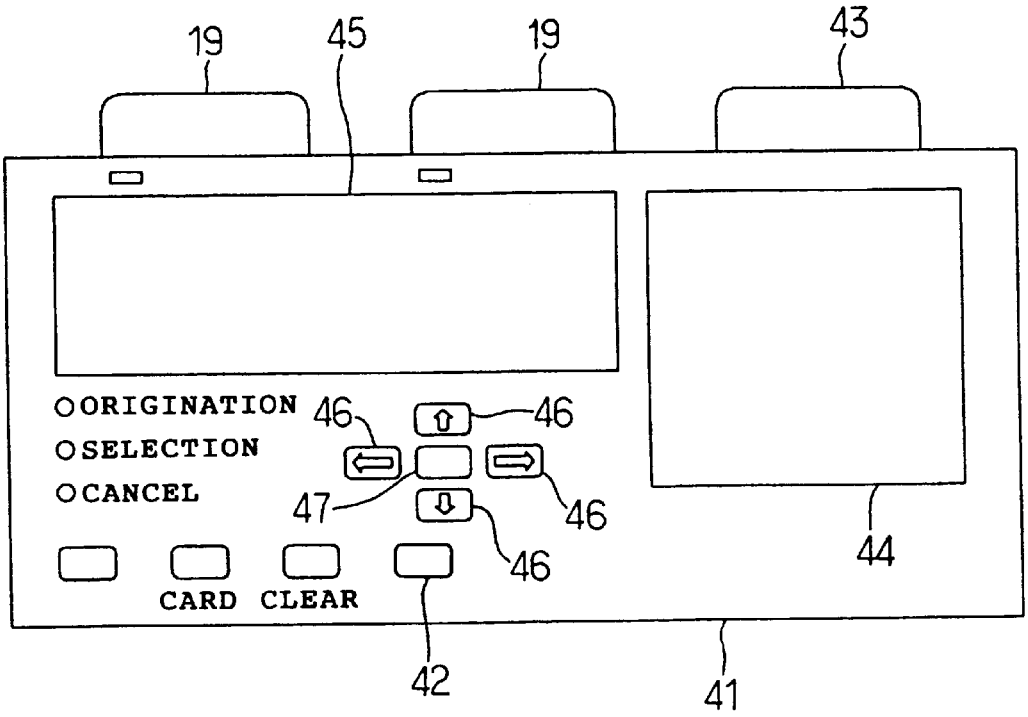
FIG. 12 is a top plan view of the embroidery pattern forming device in accordance with a second embodiment of the invention.

FIG. 12 illustrates a second embodiment of the invention. In the second embodiment, the invention is applied to an embroidery forming device disclosed in Japanese patent publication No. 6-86881-A. The embroidery pattern forming device is provided for reading the embroidery data stored in the external ROM card 19 in the first embodiment and editing the read embroidery data. The differences between the first and second embodiments will be described.

The embroidery pattern forming device comprises a device body 41 having a type selecting key 42 provided on the top thereof. The type selecting key 42 is operated to set the type of the embroidery machine. Three card insertion holes (not shown) are formed in one side of the device body 41. The external ROM card 19 is inserted into left-hand two of the card insertion holes. An external ROM card 43 is inserted into the other card insertion hole. The external ROM card 43 is provided for storing the embroidery data edited as will be described later.

Two liquid crystal displays (LCDS) 44 and 45 are mounted on the top of the device body 41. The right-hand LCD 44 displays a layout area (not shown) corresponding to the sewing area of the embroidery machine of the type set by the type setting key 42. The left-hand LCD 45 displays the pattern selecting screen etc. on the basis of the display data of the embroidery pattern stored in the external ROM card 19. A touch panel (not shown) is provided on the surface of the LCD 45. The touch panel includes various operation keys as well known in the art. Various operation keys such as arrow keys 46 and a decision key 47, etc. are provided below the LCD 45 on the top of the device body 41.

A control device composed of a microcomputer-based circuit is provided in the device body 41 although it is not shown. The type selecting key 42, the external ROM card 19, the LCDs 44 and 45, and the operation keys are connected to the control device. The control device (ROM) stores a control program for controlling display of the LCDs 44 and 45, a data processing program for performing various data processes such as readout and edit of embroidery data, size data of the sewing areas corresponding to the types of the embroidery machines, data of various operation expressions.

In operation of the embroidery forming device, the user first operates the type selecting key 42 to set the type of the embroidery machine. The control device then controls the LCD 44 so that a layout area according to the sewing area corresponding to the set type is displayed on the basis of the size data corresponding to the sewing area. Viewing the pattern selecting screen of the LCD 45, the user selects a desired embroidery pattern. The embroidery data of the selected embroidery pattern is then read from the external ROM card 19. The size data in the embroidery data is compared with the size data of the sewing area. When the embroidery pattern is larger than the sewing area, the sewing data in the embroidery data is converted on the basis of a predetermined operation expression. Furthermore, the image data is originated from the converted sewing data. The embroidery pattern is displayed in the layout area of the LCD 44 on the basis of the originated image data. In this state, when the arrow keys 46 are operated, the sewing data and the image data are re-written and the embroidery pattern displayed in the layout area is moved.

Upon operation of the decision key 47, the control device writes the sewing data and the image data into the external ROM card 43. Thus, the same effect can be achieved in the second embodiment as in the first embodiment.

Although the embroidery data is stored only in the external ROM card 19 in the second embodiment, the embroidery data may be stored in internal storage means such as a ROM or hard disk system so that the embroidery data is read from the internal storage means. Furthermore, when the pattern selecting screen etc. displayed on the LCD 45 differ from those displayed on a display of the selected embroidery machine, the display data may be converted so as to correspond to the pattern selecting screens of the display of the selected embroidery machine. In this case, the displayed contents concerning the embroidery pattern can be displayed so as to match the pattern selecting screen etc. of the displays of the individual embroidery machines.

The above-described first and second embodiments may be modified as follows. In the foregoing embodiments, the embroidery data (sewing data) is converted so as to correspond to the size of the sewing area of the embroidery machine. The embroidery data may be converted so as to correspond to the form of sewing area, instead. For example, the embroidery data may be converted so that the embroidery data set to correspond to a circular sewing area corresponds to a square sewing area. This converting manner is suitable for the processing of an embroidery pattern which maintains the identity even when its form is changed, for example, frame patterns employed for the hemming of emblems or Wappen.

In the foregoing embodiments, when the embroidery pattern is larger in the size than the sewing area, the sewing data is converted so that the embroidery pattern has the maximum size in which the embroidery pattern falls within the sewing area. However, the embroidery data may be converted in a predetermined reduction ratio according to the ratio of the size of the embroidery pattern to the size of the sewing area, instead. Furthermore, when the embroidery pattern is smaller in the size than the sewing area, the pattern data may be converted so that the embroidery pattern has the maximum size in which the embroidery pattern falls within the sewing area, or the pattern may be converted in a predetermined enlargement ratio. Additionally, the reduction ratio or enlargement ratio of the embroidery pattern may optionally be set so that the embroidery data is converted in the set ratio.

The image data is-originated on the basis of the converted sewing data so as to correspond to the size of the layout area of the LCD 17 or 44 in each of the foregoing embodiments. However, the image data may be originated so as to have a maximum size in which the embroidery pattern is displayed in the layout area, instead. Furthermore, the image data to be originated may corresponds to the number of dots of the LCD 17 or 44.

The needle movement data includes the amount of movement of the embroidery frame for every stitch in the foregoing embodiments. However, the data may include the position (X direction coordinate and Y direction coordinate) of the embroidery frame for every stitch, instead. Furthermore, although the touch panel and the operation keys are provided for the selecting operation and the editing operation in the foregoing embodiments, a mouse may be provided for the same purpose, instead.

A control program for operating the embroidery data processing device may be stored in a storage medium such as a floppy disk or CD-ROM. In this case, the conversion of the embroidery data can be executed through a personal computer on the basis of the control program stored in the storage medium. The control program may be stored in the external ROM card 19 (embroidery card). In this case, the embroidery data of the embroidery patterns larger than the sewing area of the embroidery machine can be used even if the embroidery machine is not stored with the control program. Additionally, a ROM (control device) storing the control program may be replaced by a ROM (control device) of a conventional embroidery machine.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

I claim:

1. An embroidery data processing device comprising:

storage means for storing embroidery data used when an operation pertaining to an embroidery pattern is executed by sewing means in relation to a predetermined working area, said storage means storing working area size data;

readout means for reading the embroidery data from the storage means; and conversion means for converting the embroidery data read by the readout means so that the embroidery data corresponds to a second working area differing from the predetermined working area.

2. An embroidery data processing device according to claim 1, which further comprises a device body, and wherein the storage means comprises external storage means connected to the device body.

3. An embroidery data processing device according to claim 1, wherein the conversion means converts the embroidery data so that the embroidery data corresponds in size to said another working area.

4. An embroidery data processing device according to claim 2, wherein the conversion means converts the embroidery data so that the embroidery data corresponds in size to said another working area.

5. An embroidery data processing device according to claim 1, wherein the conversion means converts the embroidery data so that the embroidery data corresponds in configuration to said another working area.

6. An embroidery data processing device according to claim 2, wherein the conversion means converts the embroidery data so that the embroidery data corresponds in configuration to said another working area.

7. An embroidery data processing device according to claim 1, wherein the embroidery data includes sewing data used when the embroidery pattern is sewn, and the conversion means converts the sewing data so that the embroidery pattern has a maximum size in which the embroidery pattern falls within said another working area.

8. An embroidery data processing device according to claim 2, wherein the embroidery data includes sewing data used when the embroidery pattern is sewn, and the conversion means converts the sewing data so that the embroidery pattern has a maximum size in which the embroidery pattern falls within said another working area.

9. An embroidery data processing device according to claim 1, which further comprises working area display means for displaying the working area, and wherein the conversion means converts the embroidery data to image data used when the embroidery pattern is displayed in the working area on the working area display means.

10. An embroidery data processing device according to claim 2, which further comprises working area display means for displaying the working area, and wherein the conversion means converts the embroidery data to image data used when the embroidery pattern is displayed in the working area on the working area display means.

11. An embroidery data processing device according to claim 9, wherein the image data has a maximum size in which the embroidery pattern falls within the working area displayed on the first display means.

12. An embroidery data processing device according to claim 10, wherein the image data has a maximum size in which the embroidery pattern falls within the working area displayed on the first display means.

13. An embroidery data processing device according to claim 1, wherein the embroidery data includes display data used when a display mode of the embroidery pattern is displayed on a predetermined display area of embroidery pattern display means provided in the sewing machine, and the conversion means converts the display data so that the display data corresponds to a display area of the embroidery pattern display means differing from the predetermined display area.

14. An embroidery data processing device according to claim 2, wherein the embroidery data includes display data used when a display mode of the embroidery pattern is displayed on a predetermined display area of embroidery pattern display means provided in the sewing machine, and the conversion means converts the display data so that the display data corresponds to a display area of the embroidery pattern display means differing from the predetermined display area.

15. A sewing machine comprising:

sewing means for sewing an embroidery pattern so that the embroidery pattern falls within a predetermined working area;

a readout circuit for reading embroidery data stored in external storage means and corresponding to a working area differing from the predetermined working area, the readout circuit further reading working area size data stored in the external storage means; and a conversion circuit for converting the embroidery data read by the readout circuit so that the embroidery data corresponds to the predetermined working area.

16. A storage medium for storing a control program for operating an embroidery data processing device processing embroidery data and working area size data stored in storage means and used when an operation pertaining to an embroidery pattern is executed by the sewing machine in relation to a predetermined working area, the control program accomplishing the functions of:

readout means for reading the embroidery data and working area size data from the storage means; and conversion means for converting the embroidery data read by the readout means so that the embroidery data corresponds to a second working area differing from the predetermined working area.

17. An embroidery data processing device according to claim 1, wherein the conversion means converts the embroidery data read by the readout means based on the second working area.

18. A sewing machine according to claim 15, wherein the conversion circuit converts the embroidery data read by the readout circuit based on the working area differing from the predetermined working area.

19. A storage medium according to claim 16, wherein the conversion means converts the embroidery data read by the readout means based on the second working area.

* * * * *